US007452131B2

(12) United States Patent
Kettner et al.

(10) Patent No.: US 7,452,131 B2
(45) Date of Patent: Nov. 18, 2008

(54) RECLOSABLE PLASTIC STORAGE BAGS WITH AUTOMATICALLY PRINTED ZIPPERS

(75) Inventors: Catherine E. Kettner, Appleton, WI (US); Bill C. Munger, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 293 days.

(21) Appl. No.: 10/668,994

(22) Filed: Sep. 22, 2003

(65) Prior Publication Data

US 2005/0063621 A1 Mar. 24, 2005

(51) Int. Cl.
*B65D 33/16* (2006.01)
*A44B 19/00* (2006.01)

(52) U.S. Cl. ..... 383/63; 24/585.12

(58) Field of Classification Search ..... 383/63; 24/585.12

See application file for complete search history.

(56) References Cited

U.S. PATENT DOCUMENTS

| | | | | |
|---|---|---|---|---|
| 4,285,105 | A | 8/1981 | Kirkpatrick | |
| 4,829,641 | A | 5/1989 | Williams | |
| 4,907,321 | A | 3/1990 | Williams | |
| 5,033,868 | A * | 7/1991 | Peppiatt | 383/29 |
| 5,103,979 | A | 4/1992 | Hustad | |
| 5,248,201 | A | 9/1993 | Kettner et al. | |
| 5,356,222 | A | 10/1994 | Kettner et al. | |
| 5,397,182 | A | 3/1995 | Gaible et al. | |
| 5,566,429 | A | 10/1996 | Martinez et al. | |
| 6,135,636 | A | 10/2000 | Randall | |
| 6,442,804 | B2 | 9/2002 | Turvey et al. | |
| 6,808,666 | B2 * | 10/2004 | Fukumori et al. | 264/145 |
| 6,877,898 | B2 * | 4/2005 | Berich et al. | 383/63 |

FOREIGN PATENT DOCUMENTS

| | | | |
|---|---|---|---|
| EP | 0 089 680 A2 * | 9/1983 | 383/63 |

* cited by examiner

*Primary Examiner*—Jes F Pascua
(74) *Attorney, Agent, or Firm*—Merchant & Gould P.C.

(57) ABSTRACT

A container has a pair of side walls for defining a container interior and at least one open end. The container also includes a reclosable sealing device including a first locking member and a second locking member, each formed with a web respectively extending along the side walls adjacent the open end. The first and second locking members are repeatedly matable so that upon mating engagement of the first and second locking members along their substantially entire lengths, the open end is substantially entirely closed. Visual indicia means are provided by printing automatically and directly applied along substantially an entire length of an outer surface of at least one of the first and second locking members to present various graphics for identity or aesthetic purposes and facilitate locating and closing the sealing device.

12 Claims, 2 Drawing Sheets

RECLOSABLE PLASTIC STORAGE BAGS WITH AUTOMATICALLY PRINTED ZIPPERS

FIELD OF THE INVENTION

The present invention relates generally to reclosable plastic storage bags and, more particularly, to reclosable plastic bags formed with extruded plastic side walls with a profile strip or web, along an open end of the bag, for receiving printed information.

BACKGROUND OF THE INVENTION

Various types of plastic container bags utilize a pair of closure strips respectively having male and female members which interlock together to close an open end of the container bags to seal its interior from the external environment. The strips and associated container side walls are typically each formed from thermoplastic material. The container side walls are usually formed by extrusion. A sheet of extruded material is folded, forming two walls, or the two walls are constructed as two separate panels which are then heat sealed together along two or three edges to define the container and an open end along one side thereof. The closure strips are also usually formed by extrusion and then connected to the side walls of the container along the open end by heat sealing or other suitable means to define what is known as a reclosable profile.

Each closure strip is preferably coextruded with a web member which is heat sealed or otherwise secured to one of the side walls of the container body. More specifically a first web generally has an extruded layer formed with an upper web portion and a lower web portion extending coextensive with a first closure strip thereon. This closure strip contains a first locking member projecting inwardly from an inner surface of the first web between upper and lower web portions, to matingly engage a second locking member defining a second closure strip which is coextruded with a second web also having an upper web portion and a lower web portion. The first and second locking members are either male or female, respectively, to mate with each other, and form a sealing device known as a zipper. The lower web portions are heat sealed to the upper edge of respective ones of the plastic side walls as is known. The upper web portions project upwardly from their associated closure strips to respectively define what are commonly known as a top or consumer side web located between the reclosable profile and the open end of the container. Typically, these webs, also known as flanges, are formed to allow for finger gripping to enable the consumer to grasp both side walls and enable separation of the side walls by pulling them away from each other to facilitate unlocking of the zipper.

It has become increasingly desirable to provide reclosable plastic bags with color indicators for locating and closing the zipper. Many customers in the reclosable plastic bag market are looking to various forms of color and graphics to assist with functional and aesthetic purposes in the bag making process. Existing technology in this area typically provides an extruded color line behind, in, above or below the locking members forming the zipper or within the upper and lower webs. This color line can be costly due to the need for a separate extrusion blend to introduce the line. In addition, the color line cannot be intermittent, or be in the form of a logo or printed message because of current manufacturing limitations. Color lines are normally provided through a second layer extrusion done either within the dye or after in a post extrusion fashion.

It is desirable to enhance plastic bag manufacturing using known color indicators by providing the webs with the direct and automatic printing of a color line in the vicinity of the zipper to add flexibility, cost reduction and the ability to offer value added features. Such features include assisting in the identification of source and/or product, and enabling a plastic bag user to more efficiently locate and close the zipper. Such improvements include being able to produce more than one color in a single line of printing, printing logos, customer names or other identification on the zipper and printing intermittently. The color line should also be able to create various graphics and design patterns such as waves and dots in raised or recessed areas and to provide holographic printing, tattoo, photos and picture transfer and the like.

SUMMARY OF THE INVENTION

The present invention advantageously relates to a container having a pair of side walls for defining a container interior and at least one open end. The container has a reclosable sealing device including a first locking member and a second locking member, each formed with a web respectively extending along the side walls adjacent the open end. The first and second locking members are repeatedly matable so that upon mating engagement of the first and second locking members along their substantially entire lengths, the open end is closed. The invention is improved by visual indicia means provided by printing automatically and directly applied substantially entirely across at least one of the webs in the vicinity of the first and second locking members to present various graphics for identity or aesthetic purposes, and facilitate locating and closing the sealing device.

In accordance with a further aspect of the invention, a web arrangement is provided including a pair of webs to be secured to a pair of side walls of a container having a reclosable open end. The web arrangement includes a first locking member formed on one of the webs, and a second locking member formed on the other of the webs. The first and second locking members are repeatedly matable so that upon mating engagement of the first and second locking members along their substantially entire lengths, the open end is substantially entirely closed. Visual indicia means are directly printed along substantially an entire length of at least one of the first and second locking members before the webs are secured to the side walls of the container.

It is one object of the present invention to provide an improved reclosable plastic bag having a printed area with varying colors and graphics extending across the zipper.

It is also an object of the present invention to provide a reclosable plastic bag with visual indicia which is aesthetically and functionally useful.

It is another object of the present invention to provide automatic and direct printing on the webs of a reclosable plastic bag.

It is a further object of the present invention to provide printing across substantially the entire length of the zipper before, during or after the webs are attached to the side walls.

It is an additional object of the present invention to provide periodic or repeated linear printing of symbols, logos, names, messages, slogans, terms and the like on reclosable plastic bags.

Another object of the present invention is to provide a plastic bag making process which allows for more creativity while offering a lower cost option.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF PREFERRED EMBODIMENTS

Figure 1:
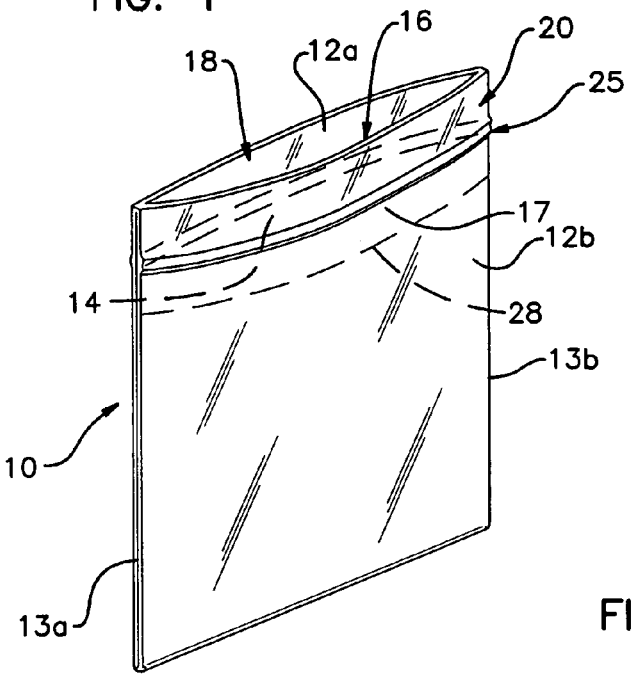
FIG. 1 is a perspective view of a reclosable plastic bag formed with a pair of locking members which are automatically and directly printed according to the present invention.

FIG. 1 is an illustration of a container such as a plastic bag 10 formed with a pair of plastic side walls 12*a*, 12*b* which may be heat sealed together along edges 13*a*, 13*b* to define a container interior 14 having an open end 16. The open end 16 is defined by upper edge portions 17 of the side walls 12*a*, 12*b* extending between the heat sealed edges 13*a*, 13*b*. An interlocking closure device includes a first closure strip or web 18 from which projects an arrangement of a first locking member 22 repeatedly matable with a, second locking member 24 on a second closure strip or web 20 defining the opposite side of the closure device. Together, the locking members 22, 24 define a sealing device known as a zipper 25. The webs 18, 20 have lower web portions 26 which are respectively heat sealed at 28 to the inside surface of one of the upper edge portions 17 of the side walls 12*a*, 12*b* and are preferably coextruded with their associated locking members 22, 24.

Figure 2:
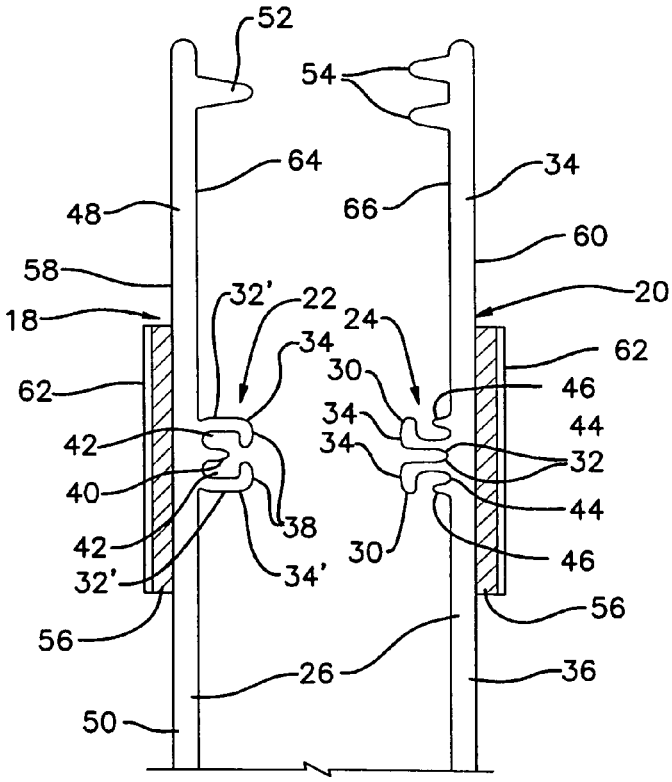
FIG. 2 is a sectional view of the locking members in an unlocked condition.
Figure 3:
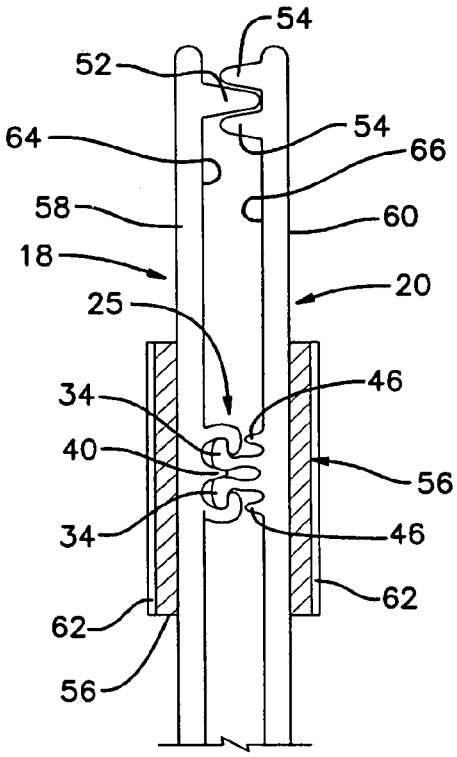
FIG. 3 is a sectional view similar to FIG. 2 of the locking members in an interlocked condition.
Figure 5:
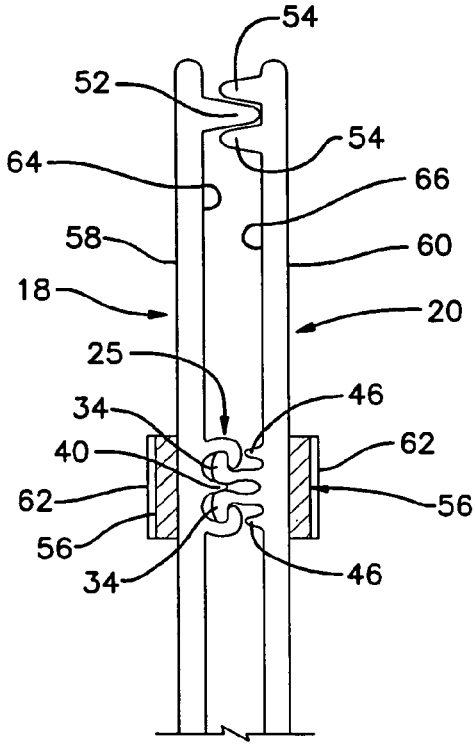
FIG. 5 is a view like FIG. 3 but showing the printing confined along the zipper.
Figure 4:
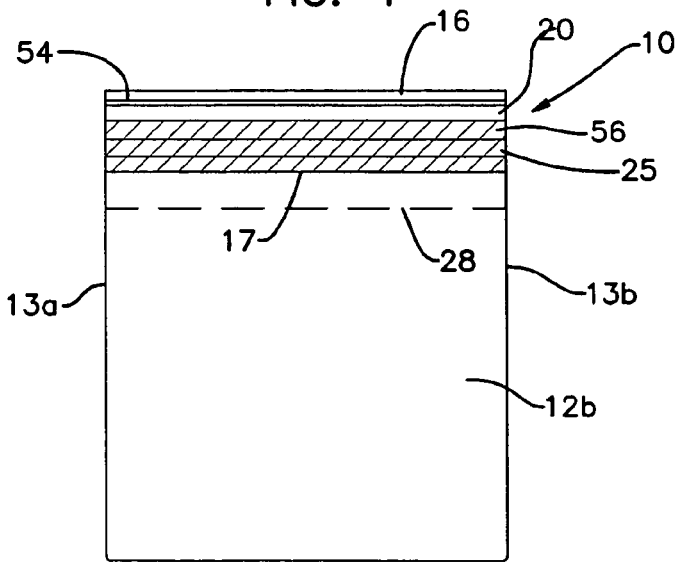
FIG. 4 is a front view of the reclosable plastic bag.

FIGS. 2 and 3 are sectional views of the bag 10 of FIG. 1 wherein the matable webs 18, 20 are depicted in unlocking and locking positions, respectively. The second locking member 24 on second web 20 includes a pair of hook-like projections 30 extending inwardly from web 20 in spaced, parallel relationship to one another. Each hook-like projection 30 is formed with a rib 32 of stem or stalk-like configuration extending generally perpendicular to web 20 and having a hook-like distal end or tip 34 extending approximately perpendicular to its stem 32. The web 20 is formed with an upper web portion 34 and a lower web portion 36 whose outer surface is adapted to be heat sealed to the inner surface of associated bag side wall 12*b*.

The first locking member 22 on the first web 18 is also formed with a pair of hook-like projections 38 extending inwardly from web 18. These hook-like projections 38 are formed with a stem-like rib 32' and a hook tip 34' that may be substantially identical to hook-like projections 30 except that the stems 32 of the projections 38 on the web 18 are spaced further apart from each other than the stems 32 on the second web 20. This defines, in cooperation with a wall or partition 40 extending parallel to and between the projections 38, a pair of locking channels or cavities 42. The projections 30 on web 20 are adapted to enter into the locking cavities 42 by virtue of resiliently yielding bias or deflection of the tips 34, 34' of the respective projections 30, 38 as the webs 18, 20 are brought together under manual finger pressure, or with the used of a mechanical closing device, such as a slider, during closing of the bag 10. As depicted in FIG. 3, full mating engagement of locking members 22, 24 results in sealing contact between outermost portions of the tips 34 with wall 40 of the cavities 42 and corresponding sealing contact between the outermost surface of tips 34' and a corresponding locking cavity 44 formed between the projections 30 and associated walls 46 formed outwardly and parallel thereto. The web 18 may be formed with both an upper web portion 48 and a lower web portion 50. The webs 18, 20 may be provided with gripping ridges 52, 54, respectively, at the tops of the upper web portions 48, 34, respectively, to facilitate separation of the interlocked webs 18, 20 and opening of the bag 10.

In accordance with the present invention, substantially central portions of webs 18, 20 are automatically and directly printed with visual indicia means 56 identified by cross hatching in predetermined areas. More particularly, the webs 18, 20 are printed along at least their outside surfaces 58, 60, respectively, on or in the vicinity of the locking members 22, 24 forming the zipper 25 and across substantially the entire length of the zipper 25 before the webs 18, 20 are secured to the side walls 12*a*, 12*b* of bag 10. In the drawings, the visual indicia means 56 is shown extending slightly above and below the zipper 25 along substantially the entire length thereof and it is to be noted that printing may be applied at other locations on the webs 18, 20. If desirable, the printed visual indicia means 56 may be coated with a clear lamination layer 62 (FIGS. 2 and 3). It should be understood that the visual indicia means 56 may be printed on one or both outer surfaces 56, 58 of the respective webs 18, 20 as well as one or both inner surfaces 64, 66 of the respective webs 18, 20.

Preferably, the visual indicia means 56 is printed in a linear fashion in at least one color following extrusions of webs 18, 20, and may take many graphic forms such as logos, product and/or customer identification, advertising, messages, slogans, trademarks, contest promotions and the like. Examples of visual indicia means 56 include, but are not limited to, holographic printing, raised or recessed printing, varied printing covered with a fusion web and tattoo, picture and photo transfer. Printing of the visual indicia means 56 is intermittent or continuous as desired.

The present invention thus provides for extreme flexibility in the customizing of the reclosable plastic bag and has been found to do so at a reasonable cost. The present invention conveniently allows for a markedly expanded range of design options when considering producing a run of plastic bags. From a functional standpoint, printing of visual indicia means 56 in the prescribed area of the webs 18, 20 guides and focuses the bag user in locating and closing the zipper 25 which has been difficult for some users.

Having described the presently preferred embodiments, it is to be understood that the invention may be otherwise embodied within the scope of the appended claims.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. In a container comprising a pair of side walls for defining a container interior and at least one open end, and a reclosable sealing device including a first locking member and a second locking member, each formed with a web respectively attached to the side walls adjacent the open end, the webs of the reclosable sealing device defining exterior surfaces of the container and interior surfaces opposingly oriented, the first and second locking members being formed on the opposing interior surfaces, the first and second locking members being repeatedly matable so that upon mating engagement of the first and second locking elements along their substantially entire lengths, the open end is substantially entirely closed, the improvement comprising:

printed color visual indicia means provided by printing automatically and directly applied to the exterior surface of at least one of the webs, the printed color visual indicia applied to the exterior surface overlying the first and second locking members formed on the interior surface to present various graphics for identity or aesthetic purposes and facilitate locating and closing the sealing device;

wherein the printed color visual indicia means is coated with a clear lamination layer.

2. The container of claim 1 wherein the visual indicia means is selected from the group consisting of holographic printing, raised or recessed printing, varied printing covered with a fusion web and tattoo, picture or photo transfer.

3. The container of claim 1 wherein the visual indicia means is printed substantially across the entire length of at least one of the webs.

4. The container of claim 1 wherein the visual indicia means is printed intermittently across the entire length of at least one of the webs.

5. A web arrangement having a pair of webs to be secured to a pair of side walls of a container having a reclosable open end, the web arrangement comprising:

a first locking member formed on an first interior surface of one of the webs;

a second locking member formed on a first interior surface of the other of the webs, the first and second locking members being repeatedly matable so that upon mating engagement of the first and second locking members along their substantially entire lengths, the open end is substantially entirely closed, and printed color visual indicia means directly printed along a length of at least one of the webs before the webs are secured to the side walls of the container, the printed color visual indicia being directly printed on a second exterior surface of the web opposite the first interior surface of the web, the printed color visual indicia means overlying the first and second locking members formed on the first interior surface of the web;

wherein the printed color visual indicia means is coated with a clear lamination layer.

6. The web arrangement of claim 5 wherein the visual indicia means is selected from the group consisting of holographic printing, raised or recessed printing, varied printing covered with a fusion web and tattoo, picture or photo transfer.

7. The web arrangement of claim 5 wherein the visual indicia means is printed substantially across the entire length of at least one of the webs.

8. The web arrangement of claim 5 wherein the visual indicia means is printed intermittently across the entire length of at least one of the webs.

9. In a container comprising a pair of side walls for defining a container interior and at least one open end, and a reclosable sealing device including a first locking member and a second locking member, each formed with a web respectively attached to the side walls adjacent the open end, the webs of the reclosable sealing device defining exterior surfaces of the container and interior surfaces opposingly oriented, the first and second locking members being formed on the opposing interior surfaces, the first and second locking members being repeatedly matable so that upon mating engagement of the first and second locking elements along their substantially entire lengths, the open end is substantially entirely closed, the improvement comprising:

a printed visual color indicator provided by printing automatically and directly applied to the exterior surface of at least one of the webs, the printed color visual indicia applied to the exterior surface overlying the first and second locking members formed on the interior surface to present various graphics for identity or aesthetic purposes and facilitate locating and closing the sealing device;

wherein the visual indicator is printed either intermittently or continuously across the entire length of at least one of the webs; and wherein the printed color visual indicator is coated with a clear lamination layer.

10. The container of claim 9 wherein the visual indicator is printed intermittently across the entire length of at least one of the webs.

11. The container of claim 9 wherein the visual indicator is printed continuously across the entire length of at least one of the webs.

12. In a container comprising a pair of side walls for defining a container interior and at least one open end, and a reclosable sealing device including a first locking member and a second locking member, each formed with a web respectively attached to the side walls adjacent the open end, the webs of the reclosable sealing device defining exterior surfaces of the container and interior surfaces opposingly oriented, the first and second locking members being formed on the opposing interior surfaces, the first and second locking members being repeatedly matable so that upon mating engagement of the first and second locking elements along their substantially entire lengths, the open end is substantially entirely closed, the improvement comprising:

a printed visual color indicator provided by printing automatically and directly applied across the exterior surface of at least one of the webs, the printed visual color indicator overlying the first and second locking members formed on the interior surface of the one web of the reclosable sealing device, the printed visual color indicator presenting various graphics for identity or aesthetic purposes and facilitate locating and closing the sealing device.

* * * * *